US005316092A

United States Patent [19]

Ilomäki

[11] Patent Number: 5,316,092

[45] Date of Patent: May 31, 1994

[54] METHOD AND APPARATUS FOR DRILLING A TUNNEL

[76] Inventor: Valto Ilomäki, Loilantie 08, SF-33470 Ylöärvi, Finland

[21] Appl. No.: 838,791

[22] PCT Filed: Sep. 27, 1990

[86] PCT No.: PCT/FI90/00231

§ 371 Date: Mar. 17, 1992

§ 102(e) Date: Mar. 17, 1992

[87] PCT Pub. No.: WO91/05137

PCT Pub. Date: Apr. 18, 1991

[30] Foreign Application Priority Data

Sep. 27, 1989 [FI] Finland ..... 894560

[51] Int. Cl.[5] ..... E21B 7/20

[52] U.S. Cl. ..... 175/62; 175/171; 175/323

[58] Field of Search ..... 175/62, 53, 94, 61, 175/86, 73

[56] References Cited

U.S. PATENT DOCUMENTS

| | | | |
|---|---|---|---|
| 2,319,512 | 5/1943 | Parrish | 175/62 |
| 2,669,441 | 4/1970 | Castanoli et al. . | |
| 3,107,741 | 10/1963 | Adams et al. | 175/62 |
| 3,851,716 | 12/1974 | Barnes | 175/62 |
| 3,870,110 | 3/1975 | Richmond . | |
| 3,902,563 | 9/1975 | Dunn | 175/62 |
| 3,917,010 | 11/1975 | Fink | 175/62 |
| 3,945,443 | 3/1976 | Barnes | 175/62 |
| 4,091,631 | 5/1978 | Cherrington | 175/62 |
| 4,226,477 | 10/1980 | Capoccia | 175/62 |

*Primary Examiner*—Ramon S. Britts
*Assistant Examiner*—Frank S. Tsay
*Attorney, Agent, or Firm*—Larson and Taylor

[57] ABSTRACT

An apparatus and a method for drilling a tunnel utilize hydraulic means comprising a cylinder and a piston to enable independent adjustment of the driving force acting on the protecting tubes and the driving force acting on the drilling tool/conveying tubes. The hydraulic means acts as a thrust bearing and moves freely in the longitudinal direction of the drilling apparatus in response to forces acting on the drilling tool which are detected as changes in pressure in the hydraulic means.

9 Claims, 1 Drawing Sheet

METHOD AND APPARATUS FOR DRILLING A TUNNEL

BACKGROUND OF THE INVENTION

1. Field of the Invention

The invention relates to a method and apparatus for drilling a tunnel, wherein there are two independent forces; the one driving the protecting tube and the other driving the drilling apparatus by means of a rotating spiral tube.

2. Description of the Prior Art

A previously known drilling apparatus as described in applicant's former patent application No. FI-891706, is one in which the protecting tube is forced into the excavated drilling head advances through the tunnel portion as the tunnel. Also the force for the tool in the drilling head is transmitted over the protecting tube. The conveying tube rests against the inner surface of the protecting tube and moves forward along with the protecting tube. There is a thrust bearing in the drill head, and so the force over the protecting tube is transmitted entirely through the thrust bearing as a force for the tool forward drive.

U.S. Pat. No. 2,669,441 the tools and the thrust bearing are in the working pit. No protecting tube is driven into the tunnel but the force into the drill head is simply brought forward by a rotating conveyor pipe.

The disadvantage of the prior art devices is lack of control of the force. On driving the drill head forward with the protecting tube, the required force changes as the length of the protecting tube grows and because of friction from different soil types. This means that the farther the drilling advances the more the information about the impact of tool forces against he front wall of the tunnel diminishes and possible obstacles cannot then be detected. Therefore, the risk of tool damage is great. In U.S. Pat. No. 2,669,441 drilling is possible only in rock or soil that needs no protecting tube to support the tunnel.

SUMMARY OF THE INVENTION

By means of the method according to this invention a crucial improvement of the said disadvantages has been achieved. In order to put this into practice, the method and apparatus of this invention are characterized in what has been presented in the patent claims.

It can be considered the main advantage of this invention that the tool driving force, which is smaller than the force driving the protecting tube, is separated as an independent and easily adjustable force. When the force has been separated by means of a hydraulic cylinder, which can yield because of pressure adjustment while functioning also as thrust bearing and therefore move freely in the longitudinal direction of the drilling apparatus, the tool hitting an obstacle can be detected immediately as rise of pressure in the hydraulic system.

BRIEF DESCRIPTION OF THE DRAWINGS

In the following the invention is more closely described with reference to the enclosed drawings where.

DESCRIPTION OF THE PREFERRED EMBODIMENTS

Figure 1:
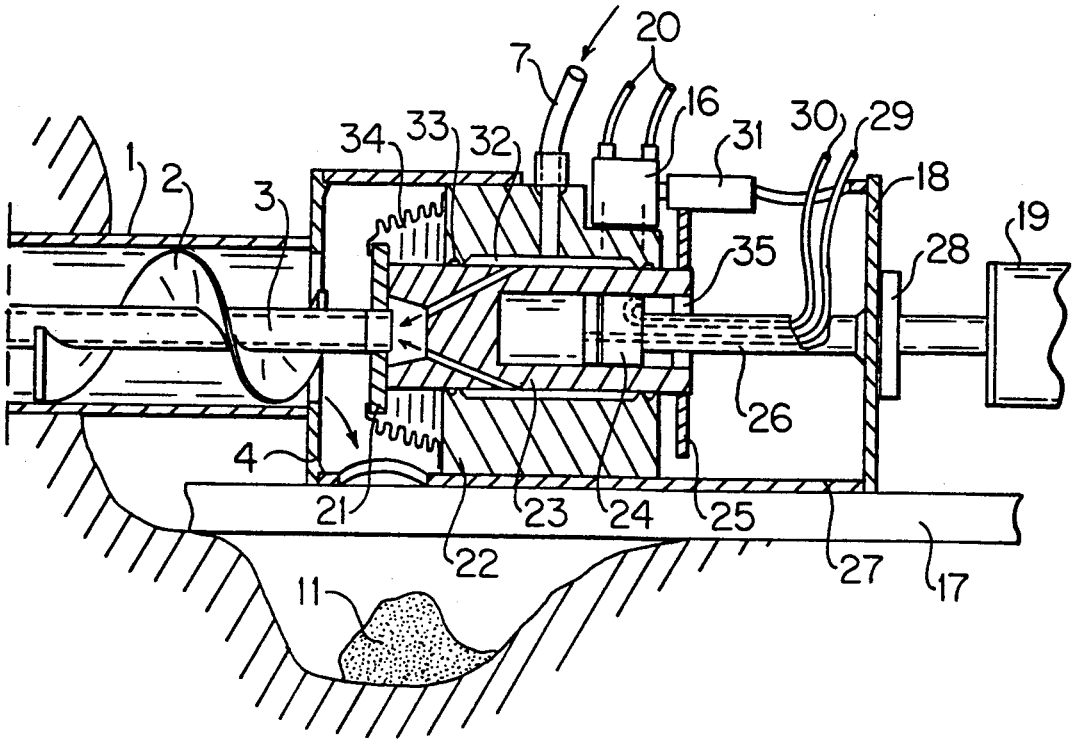
FIG. 1 is a driving and rotating unit in the working pit where the hydraulic cylinder functions as thrust bearing.

The solution in FIG. 1 provides a hydraulic cylinder (23) which functions as a thrust bearing comprised of a piston (24) and a piston rod (26). The piston rod (26) is a pipe through which the hydraulic pressure hoses (30,29) can be taken to the piston (24) and conduct the pressure fluid to the chamber space on both sides of the piston. The cylinder (23) is closed with a threaded ring flange (35). The cylinder (23) itself is a rotating drum-like part. The rotation is transmitted from the fluid motor (16) by means of a gear (25) which is attached to the cylinder (23) with a broad gear (31). The pressure fluid enters the fluid motor (16) along the hoses (20). The cylinder (23) is encircled with an immobile annular part (22), inside of which the cylinder (23) can rotate and also slide lengthwise. Part (22) is fixed to the actual frame (27) that conduits the driving force. The connecting surface between cylinder (23) and part (22) is a bearing area which also comprises an annular chamber space (32) into which compressed air is conducted through the air channels in the cylinder (23) over a hose (7) and further to rotating conveying tube (3). Tube (3) is fixed to the flange (21) by screwing. This flange (21) transmits the rotation from cylinder (23) to the conveying tube (3). The bellow rubber (34) fixed to part (22) prevents the cylinder sliding surface from getting dirty. The oil in the compressed air lubricates the sliding surface and leakage of compressed air is prevented with a retaining ring (33). The driving force to the tool from the conveying tube (3), which has a system of spiral ribs (2), is in this case transmitted over a hydraulic cylinder (23), which functions as thrust bearing, and can therefore be detected as hydraulic pressure in the hoses (29,30). Drilling waste (11) is removed through the openings in the frame (27) and between the frame beams (17) under the drilling unit.

The force driving the protecting tube (1) into the tunnel is transmitted from the power unit (19,28) direct over the rear frame (27) and its end flanges (18,4) to the protecting tube (1).

Figure 2:
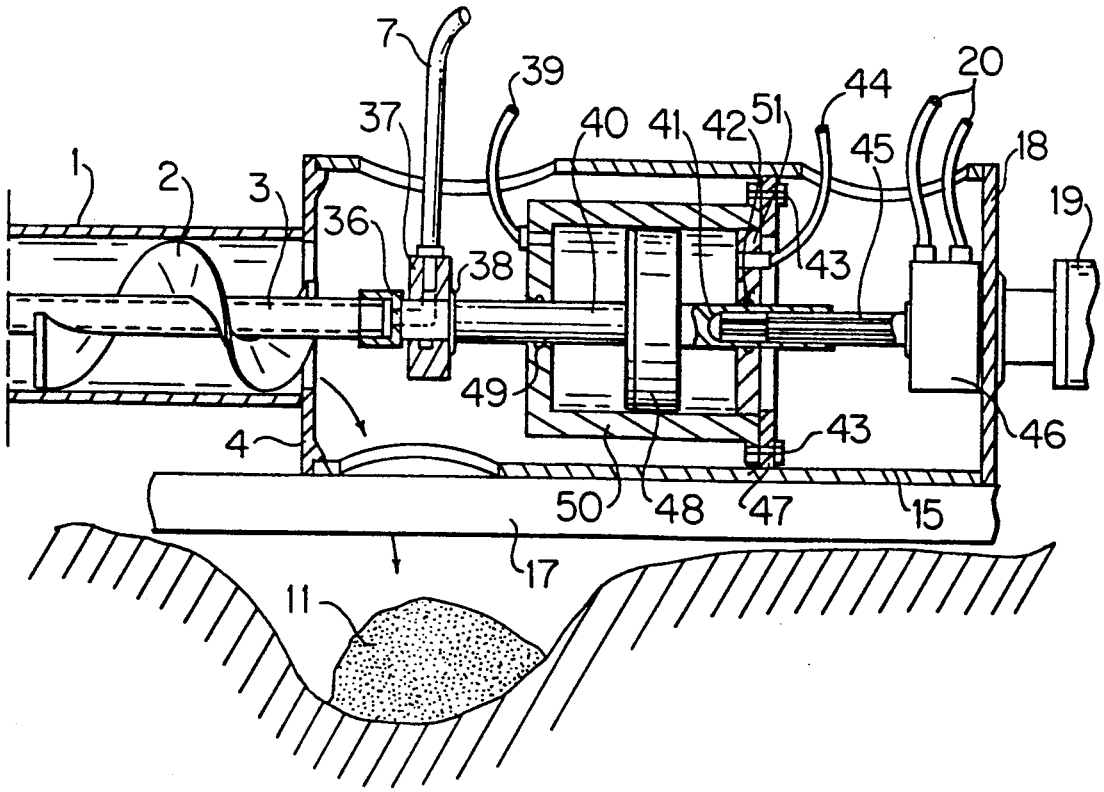
FIG. 2 is an optical driving and rotating unit placed in the working pit where the hydraulic cylinder functions as thrust bearing.

In FIG. 2 the cylinder (50) is fixed to the frame (15) with a flange (47) and screws (43). Therefore the cylinder (50) does not rotate but the piston (48) and the piston rod (40) are rotating. The fluid motor (46) comprises a grooved shaft (45) which can move longitudinally in chamber (41) formed outside the piston rod (40). Correspondingly, the chamber is also grooved to allow rotation. At piston rod rear end there is a threaded part (36) by means of which the conveying tube (3) is fixed to the piston rod (40). Around the piston rod (40) there is a not-rotating part (37) that comprises an annular chamber groove around the piston rod (40). Compressed air conducted to this chamber enters the piston rod (40) through a pick-up hole at the chamber and then the conveying tube (3) from where it reaches the tool in the drill head. Lateral movement of part (37) on the piston rod (40) is prevented by a ring spring (38) in the piston rod groove. The cylinder (50) is closed with a flange (51) attached to the cylinder (50) by screwing and joined to the piston rod (40) with a packing (42) allowing its rotation and sliding. The lines (39,44) are hydraulic hoses and the other cylinder end is sealed with a retaining ring (49).

The rotating motion of the fluid motor (46) can also easily be transmitted as a rotating motion for the piston rod (40) by connecting the motor shaft (45) e.g. by means of a flange joint to a corresponding flange in the piston rod. The fluid motor (46) must then be secured with respect to the frame (15) so that it can slide but not rotate. This can be done with conductors arranging them parallel to the frame and using them also as support for the motor (46).

This invention is not restricted to the embodiments of the prior art but it can be modified within the limits of the enclosed patent claims. The frame construction of the driving unit can be drumlike but, advantageously, also a beam construction.

What is claimed is:

1. A method of drilling a tunnel using a drilling apparatus comprising a frame having two opposed ends, a protecting tube adjacent said frame and fixed to a first of said opposed ends thereof, a conveying tube housed in said protecting tube and a drilling tool mounted on said conveying tube, said method comprising the steps of:

supplying forward driving forces to said protecting tube and said conveying tube by means of a power unit acting on a second of said opposed ends of said frame; and simultaneously supplying said forward driving force to said conveying tube by hydraulic means mounted inside said frame, said hydraulic means comprising one of the following two configurations:

a piston fixed to said frame and a cylinder fixed to said conveying tube, or a piston fixed to said conveying tube and a cylinder fixed to said frame;

whereby said forward driving force acting on said conveying tube is adjustable independently of said forward driving force acting on said tube.

2. The method according to claim 1 further comprising rotating the piston or cylinder fixed to said conveying tube to rotate said tool, said rotation being effected about an axis parallel to a longitudinal axis of said drilling apparatus during said step of supplying said forward driving force to said conveying tube.

3. The method according to claim 1 further comprising the steps of detecting changes in force acting on said drilling tool by means of pressure changes in said hydraulic means and adjusting pressure in said cylinder to compensate for said changes in force.

4. An apparatus for drilling a tunnel comprising:

a frame having two opposed ends;

a drilling tool;

a protecting tube adjacent said frame and fixed to a first of said opposed ends thereof;

a conveying tube having said drilling tool mounted thereon, said conveying tube being housed in said protecting tube;

a power unit acting on a second of said opposed ends of said frame for supplying forward driving force to said protecting tube and said conveying tube; and hydraulic means mounted inside said frame, said hydraulic means comprising one of the following two configurations:

a piston fixed to said frame and a cylinder fixed to said conveying tube, or a piston fixed to said conveying tube and a cylinder fixed to said frame;

whereby said forward driving force acting on said conveying tube is adjustable independently of said forward driving force acting on said tube.

5. The apparatus according to claim 4 wherein said piston or cylinder fixed to said conveying tube is mounted for rotation about an axis parallel to said longitudinal axis of said drilling apparatus.

6. The apparatus according to claim 5 further comprising means for conveying compressed air through said rotatable piston cylinder, through said conveying tube and to said tool.

7. The apparatus to claim 5 wherein said piston is mounted for said rotation.

8. The apparatus according to claim 5 wherein said cylinder is mounted for said rotation.

9. The apparatus according to claim 4 wherein said piston comprises a hollow piston rod, and wherein said apparatus further comprises pressure hoses extended through said hollow piston rod into said cylinder for conducting pressure fluid to said cylinder for adjustment of said forward driving force acting on said conveying tube.

* * * * *